US012540024B2

(12) United States Patent
Weinberg

(10) Patent No.: US 12,540,024 B2
(45) Date of Patent: Feb. 3, 2026

(54) DISPENSER FOR BBS

(71) Applicant: Richard B. Weinberg, Highland, MI (US)

(72) Inventor: Richard B. Weinberg, Highland, MI (US)

( * ) Notice: Subject to any disclaimer, the term of this patent is extended or adjusted under 35 U.S.C. 154(b) by 0 days.

(21) Appl. No.: 17/378,209

(22) Filed: Jul. 16, 2021

(65) Prior Publication Data

US 2022/0170726 A1 Jun. 2, 2022

Related U.S. Application Data

(60) Provisional application No. 63/119,927, filed on Dec. 1, 2020.

(51) Int. Cl.
*B65D 83/04* (2006.01)

(52) U.S. Cl.
CPC .. *B65D 83/0481* (2013.01); *B65D 2583/0477* (2013.01)

(58) Field of Classification Search
CPC ..... B65D 83/0481; B65D 2583/0477; F41B 11/52; F42B 39/26; F41A 9/64; F41A 9/83
USPC ..... 221/307, 312
See application file for complete search history.

(56) References Cited

U.S. PATENT DOCUMENTS 2,759,390 A * 8/1956 Edwards ..... F16B 21/10 16/86 A
3,204,758 A * 9/1965 Horner ..... B65D 83/0481 D9/518
3,325,052 A * 6/1967 Sauber ..... B65D 83/0409 221/256
3,398,857 A * 8/1968 Alio ..... B65D 83/0409 221/190
3,414,162 A * 12/1968 Leonforte ..... B65D 83/0409 221/266
3,796,347 A * 3/1974 Hafner ..... B65G 47/295 221/276
4,020,974 A * 5/1977 Bauer ..... F41B 11/52 222/572
4,109,980 A * 8/1978 Brockman ..... A47F 1/08 D6/571
4,282,990 A * 8/1981 Miyashita ..... G01F 11/261 222/362
4,455,915 A * 6/1984 Ransom ..... B65G 47/1407 86/26
4,564,125 A * 1/1986 Esslinger ..... F42B 39/002 222/456
4,967,723 A * 11/1990 Cutrell ..... F41B 11/51 124/50
5,054,647 A * 10/1991 Yawata ..... A61C 7/306 221/41
5,147,119 A * 9/1992 Harris ..... A47B 61/003 312/49

(Continued)

FOREIGN PATENT DOCUMENTS

CN 110182475 A * 8/2019 ..... B65D 83/0481
GB 2322438 A * 8/1998 ..... F41B 11/53

*Primary Examiner* — Rakesh Kumar

(57) ABSTRACT

A dispenser for BBs eliminates binding because the BBs first fill into a groove of the dispenser that is only wide enough to hold BB's single file. The remaining BBs fall back into the main cavity of the dispenser, allowing the BBs in the groove to pass through the dispenser hole one-by-one.

12 Claims, 5 Drawing Sheets

(56) References Cited

U.S. PATENT DOCUMENTS

| | | | | |
|---|---|---|---|---|
| 6,206,235 | B1 * | 3/2001 | Green | B65D 83/0409 221/293 |
| 6,505,756 | B1 * | 1/2003 | Walldorf | B65G 47/1478 221/241 |
| 7,861,889 | B2 * | 1/2011 | Ishigure | B65G 47/145 221/168 |
| 2007/0194059 | A1 * | 8/2007 | Clark | F42B 39/26 222/465.1 |
| 2007/0267304 | A1 * | 11/2007 | Portier | B65D 83/0481 206/204 |
| 2018/0037396 | A1 * | 2/2018 | Jacobs | B65D 83/0481 |

* cited by examiner

DISPENSER FOR BBS

CROSS-REFERENCE TO RELATED APPLICATIONS

This application claims the benefit of priority of U.S. provisional patent application No. 63/119,927, filed Dec. 1, 2020, the contents of which are herein incorporated by reference.

BACKGROUND OF THE INVENTION

1. Field of the Invention

Embodiments of the invention relate generally to dispensers. More particularly, embodiments of the invention relate to a dispenser for BBs that permit free flow without jamming or clogging.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

BBs are difficult to pour out of the container into a BB gun because they bind up on top of each other, requiring the user to continuously shake the container to dislodge the BBs. With current dispensers, the weight of the remaining BBs in the container cause the BBs to bind and jam at the smaller opening, making it difficult to pour without shaking and spilling BBs.

In view of the foregoing, there is a need for an improved dispenser for BBs that permit easy transfer into a BB gun without jamming or clogging.

SUMMARY OF THE INVENTION

The invention described herein eliminates binding because the BBs first fill into a groove that is only wide enough to hold BBs single file. The remaining BBs fall back into the main cavity of the dispenser, allowing the BBs in the groove to pass through the dispenser hole one-by-one in a single file.

Embodiments of the present invention provide a dispenser for spherical objects comprising a reservoir for holding a plurality of the spherical objects; a dispenser groove disposed along one side of the reservoir, the dispenser groove in fluid communication with the reservoir to permit at least a portion of the plurality of spherical objects to move from the reservoir to the dispenser groove, the dispenser groove formed with a partially curved inside shape to retain the portion of the plurality of spherical objects therein; and a dispenser exit opening at one end of the dispenser groove, the dispenser exit opening allowing the portion of the plurality of spherical objects to be released from the dispenser, one-by-one in a single file.

Embodiments of the present invention further provide a dispenser for BBs comprising a reservoir for holding a plurality of BBs; a dispenser groove disposed along one side of the reservoir, the dispenser groove in fluid communication with the reservoir to permit at least a portion of the plurality of BBs to move from the reservoir to the dispenser groove, the dispenser groove formed with a partially curved inside shape to retain the portion of the plurality of BBs therein; a dispenser exit opening at one end of the dispenser groove, the dispenser exit opening allowing the portion of the plurality of BBs to be released from the dispenser, one-by-one in a single file; a refill port formed in at least one surface of the dispenser; and a stopper at the dispenser exit opening, the stopper movable between an open position, where the spherical objects can move out of the dispenser groove to an exterior of the dispenser, and a closed position, where the spherical objects are prevented from being released out of the dispenser exit opening.

Embodiments of the present invention also provide a method of dispensing spherical objects from a reservoir of a dispenser containing a plurality of the spherical objects comprising turning the dispenser a first direction to allow the plurality of the spherical objects to move along an object groove fill path into a dispenser groove disposed along one side of the reservoir, the dispenser groove formed with a partially curved inside shape to retain the portion of the plurality of spherical objects therein; turning the dispenser a second direction, opposite the first direction, to move a portion of the plurality of the spherical objects that are not in the dispenser groove to move back to the reservoir away from the dispenser groove; and tilting the dispenser to allowing a portion of the plurality of spherical objects inside the dispenser groove to be released from the dispenser, one-by-one in a single file.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
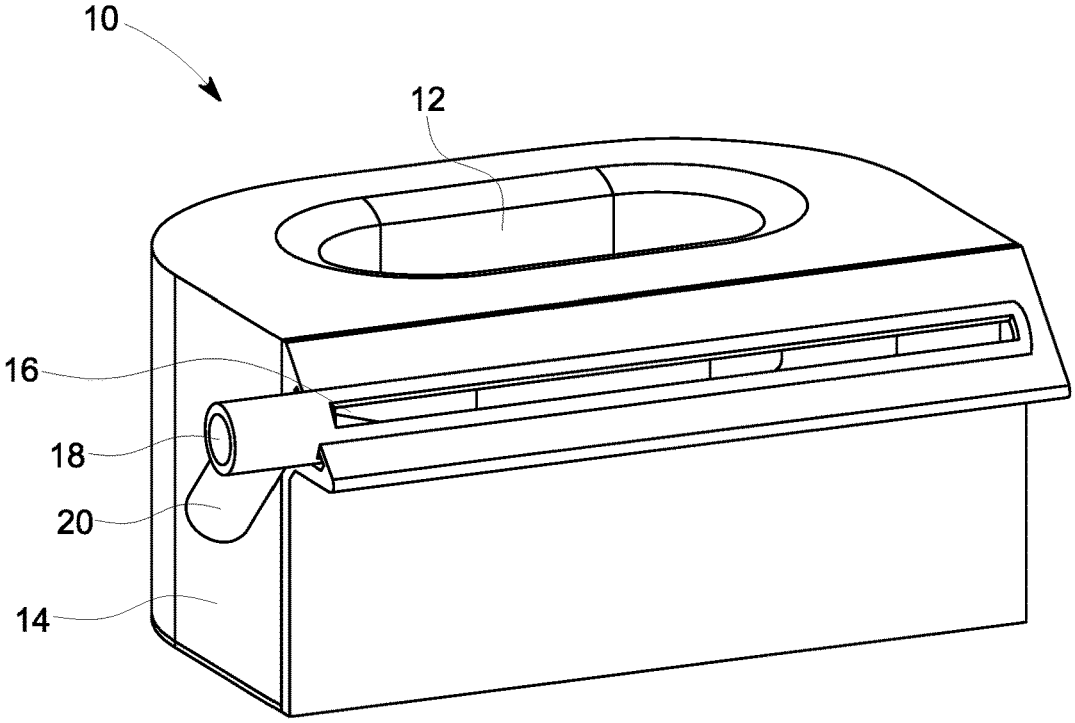
FIG. 1 illustrates a side perspective view of a BB dispenser according to an exemplary embodiment of the present invention.
Figure 2:
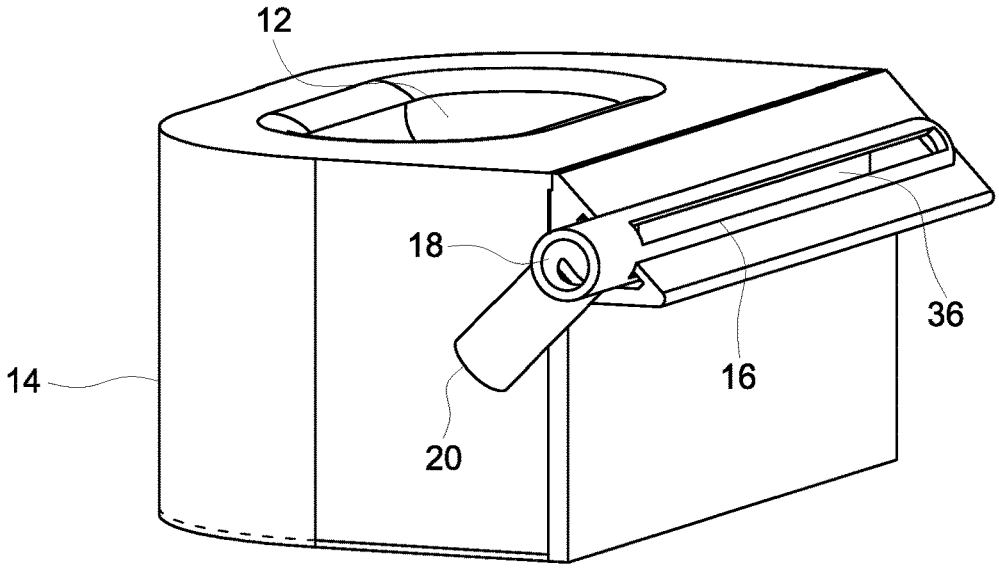
FIG. 2 illustrates a bottom perspective view of the BB dispenser of FIG. 1.
Figure 3:
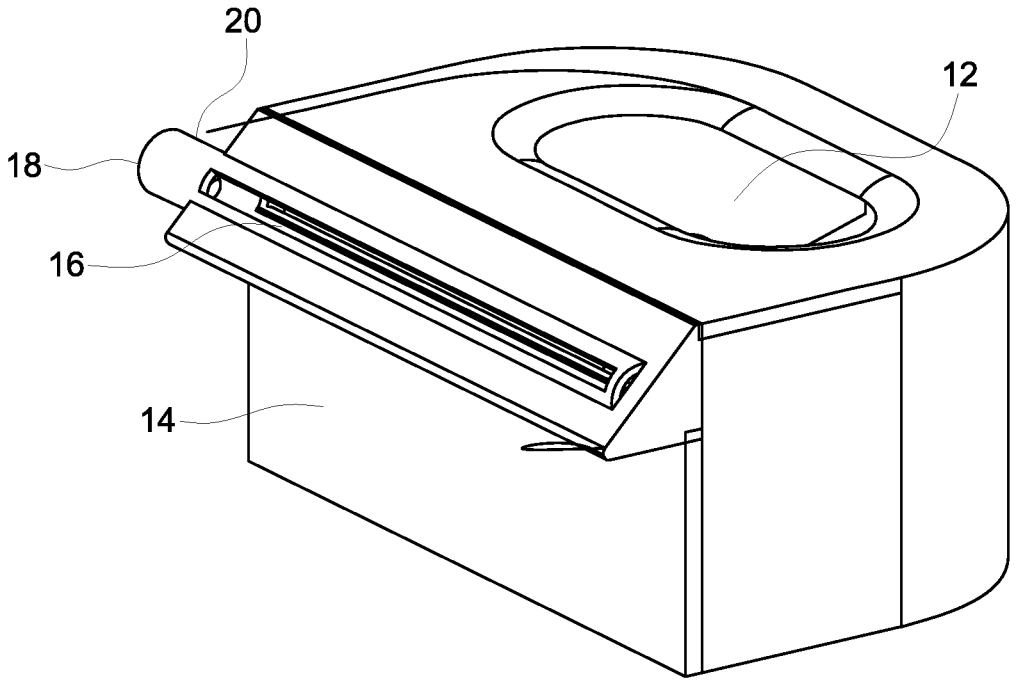
FIG. 3 illustrates top perspective view of the BB dispenser of FIG. 1.
Figure 4:
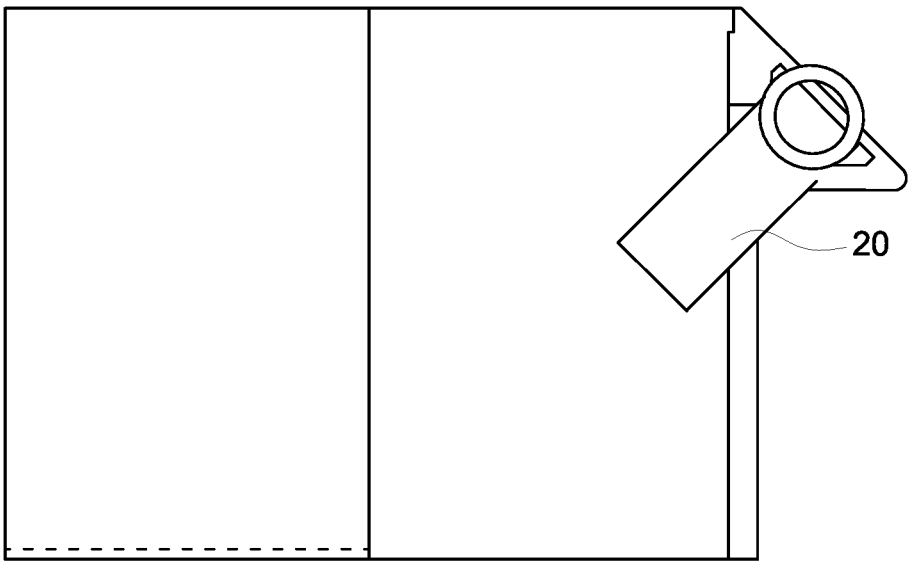
FIG. 4 illustrates a bottom side view of the BB dispenser of FIG. 1.
Figure 5:
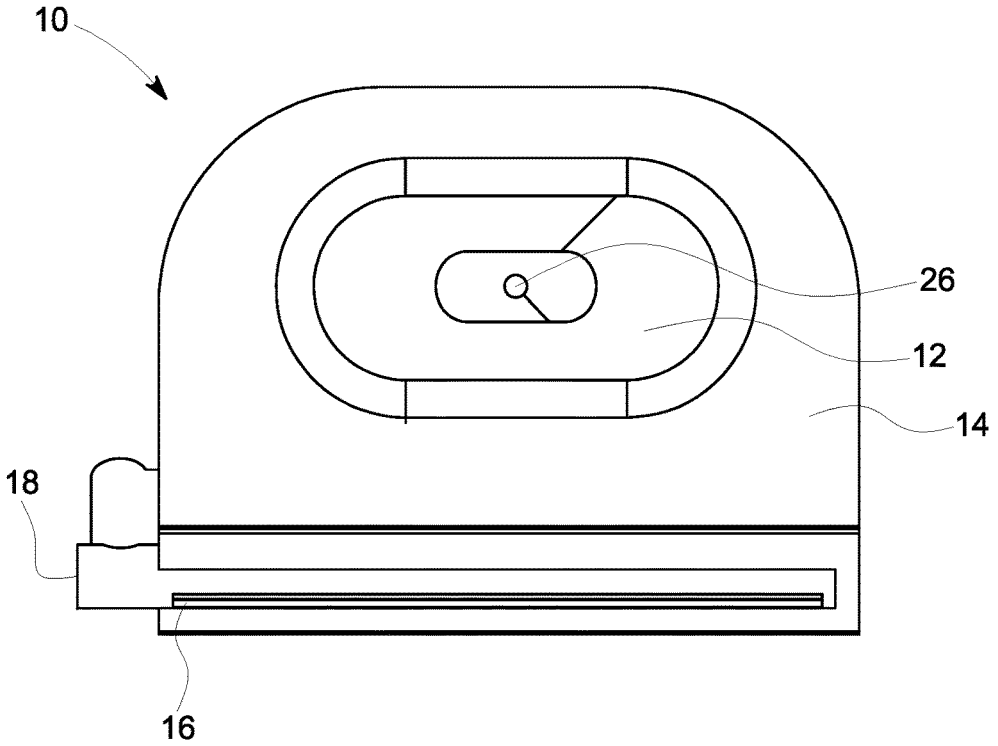
FIG. 5 illustrates a top view of the BB dispenser of FIG. 1.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any device, and in particular, the embodiments of the present invention. A commercial implementation in accordance with the spirit and teachings of the present invention may be configured according to the needs of the particular application, whereby any aspect(s), feature (s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a dispenser for BBs that eliminates binding because the BBs first fill into a groove that is only wide enough to hold BBs single file. The remaining BBs fall back into the main cavity of the dispenser, allowing the BBs in the groove to pass through the dispenser hole one-by-one. This dispenser allows BBs to be poured directly into a BB gun without binding, regardless of how many BBs are in the container.

With conventional BB fill methods, BBs were poured out of a dispenser through a hole, typically tapering down to a small opening like a funnel. Aspects of the present invention can first fill a groove with BBs by rotating the dispenser, allowing the BBs to then pour out, one-by-one, from the groove without having to taper down to a smaller hole.

BBs get stuck trying to pour out of existing dispensers because the weight of the remaining BBs causes the BBs at the bottom to bind and block the tapered opening, preventing them from flowing through the hole and exiting the dispenser. Aspects of the present invention described eliminates binding because the BBs first fill into a groove that is only wide enough to hold the BBs in a single file arrangement. The remaining BBs fall back into the main cavity of the dispenser, allowing the BBs in the groove to pass through the dispenser hole one-by-one.

Referring now to FIGS. 1 through 6, a BB dispenser 10 can include a BB reservoir 24, defined by housing 14, that can hold a plurality of BBs 28 placed therein through a refill port 12. In some embodiments, the refill port 12 can be a sloped, funnel-like structure, concavely sloped toward the BB reservoir 24 as shown in the Figures. A refill opening 26 can feed the BBs into the BB reservoir 24. In some embodiments, a BB retainer 22 may be disposed inside the BB reservoir 24 as a domed surface sloped toward the refill opening 26. Such a configuration can allow the BBs to fill the reservoir 24 but can help prevent inadvertent release of the BBs out of the reservoir 24 through the refill port 12.

Of course, other refill structures can be provided. For example, a one way valve/port could allow BBs in but prevent their exit. In some embodiments, a bulk BB tube may attach to a refill port to permit the BBs to flow directly into the reservoir 24. In some embodiments, the bulk BB tube may remain attached to the dispenser to become part of the reservoir 24 that feeds a dispenser groove 16, as discussed in greater detail below. In some embodiments, the refill port 12 may include a cap structure that opens and closes access to the inside of the reservoir, where the user can remove the cap (via a friction fit, a screw fit, or the like), fill the reservoir 24, and replace the cap.

Figure 6:
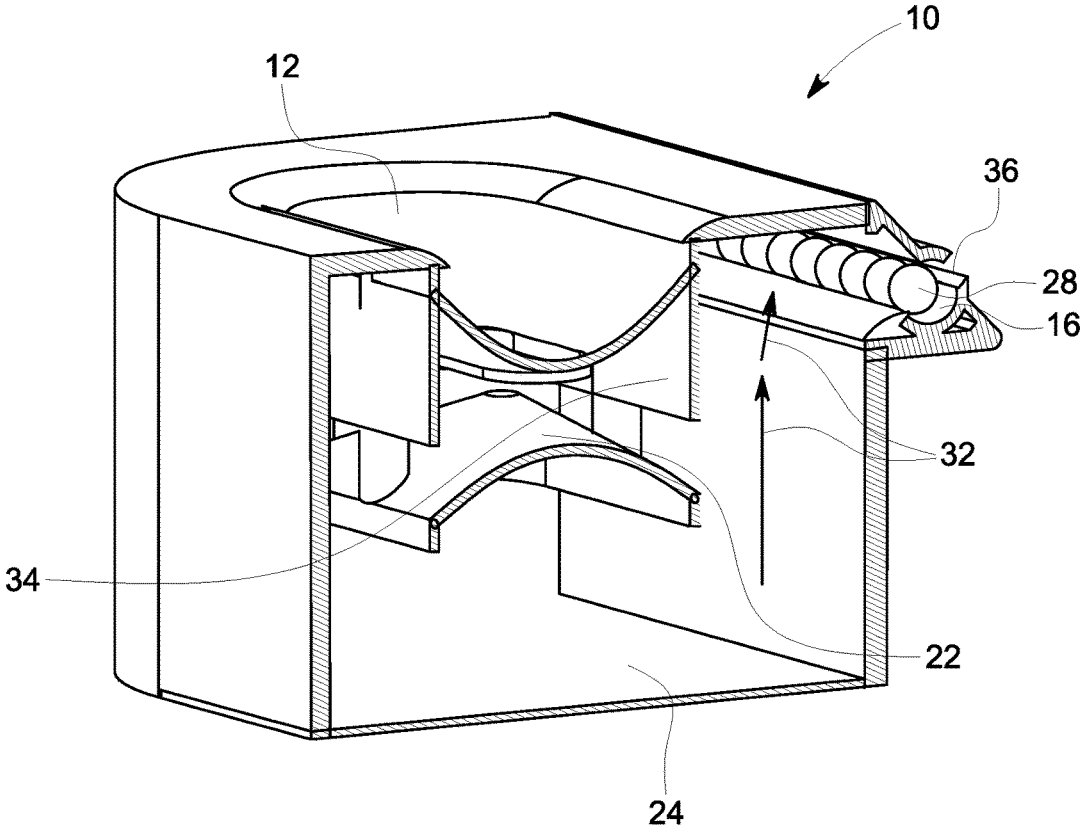
FIG. 6 illustrates a cross-sectional view of the BB dispenser of FIG. 1.
Figure 7:
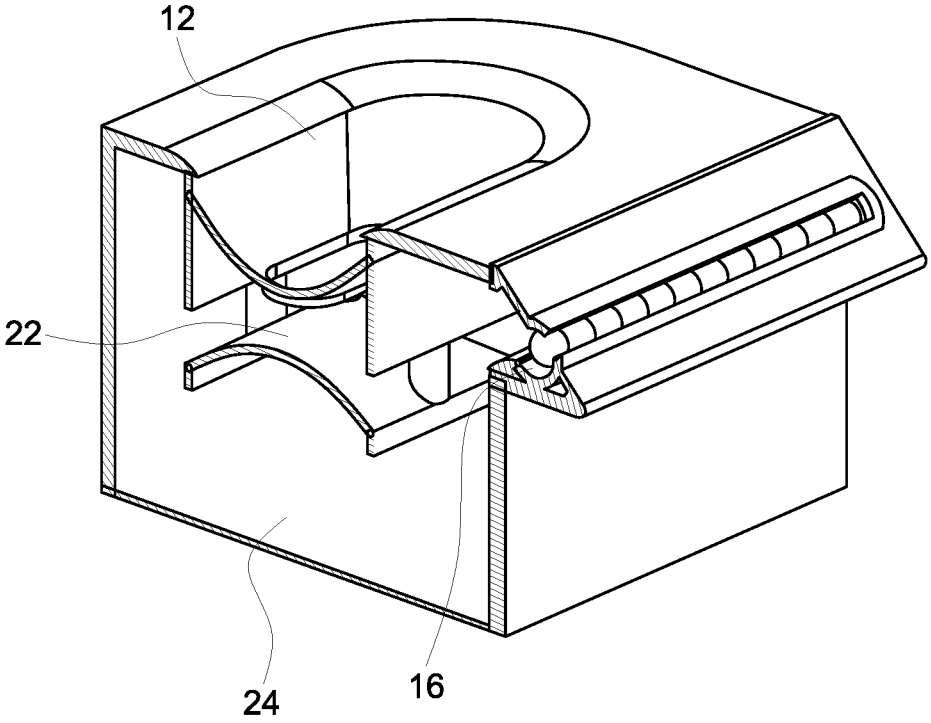
FIG. 7 illustrates side perspective view of the cross-section of FIG. 6.

The dispenser groove 16 is in fluid communication with the reservoir 24 so that BBs can travel along a groove fill path 32 to move into the dispenser groove 16. For example, a user can rotate the dispenser 10 clockwise (as seen in FIG. 6) to cause the BBs to move from the bottom of the reservoir 24, along the groove fill path 32 and into the dispenser groove 16. An internal wall 34 can be provided at least partially into the reservoir 24, adjacent the groove fill path 32. A slot 36 can be formed along at least a portion of the dispenser groove, on an exterior thereof, to permit a user to view the BBs that have filled the dispenser groove 16. The dispenser 10 can be rotated back counter-clockwise so that the BBs that are not in the dispenser groove 16 fall back to the bottom of the reservoir 24.

Figure 8:
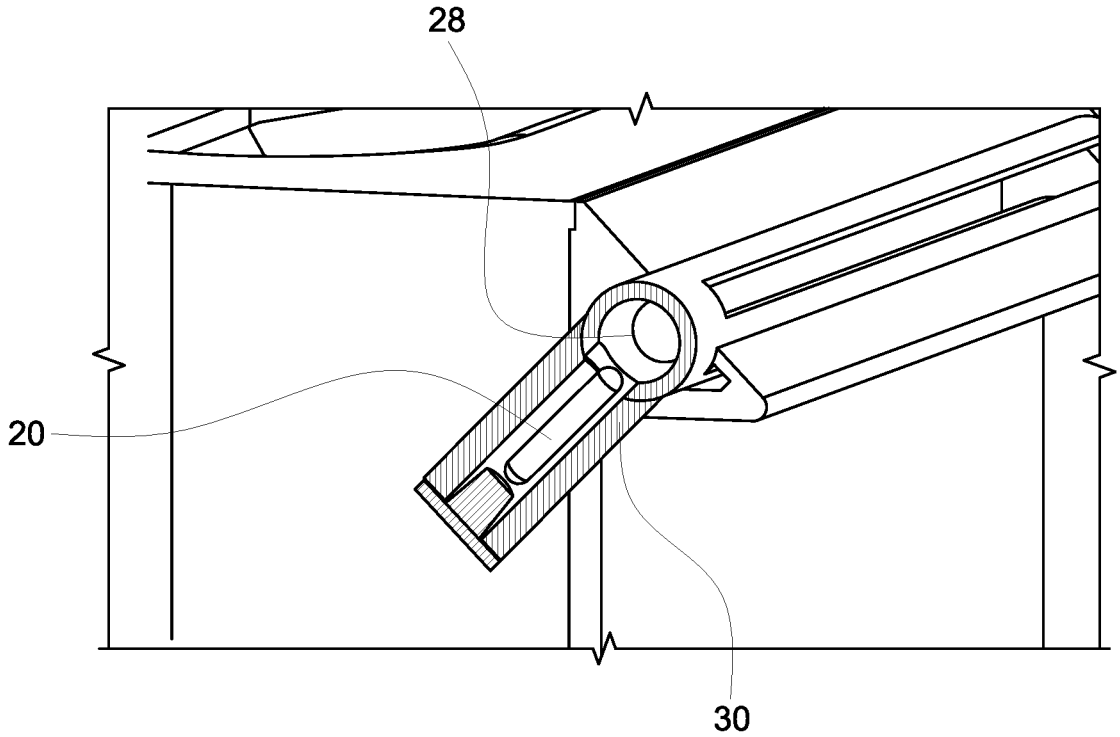
FIG. 8 illustrates a cross-sectional view of the gravity stopper of the BB dispenser of FIG. 1 in an open position.
Figure 9:
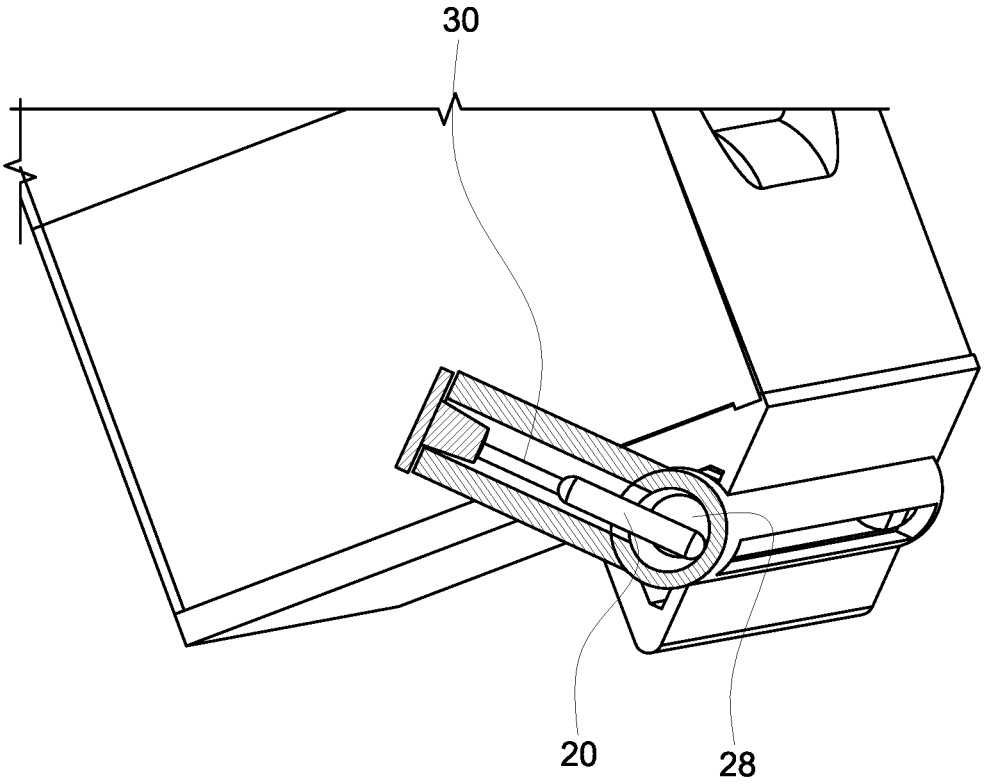
FIG. 9 illustrates a cross-sectional view of the gravity stopper of the BB dispenser of FIG. 1 in a closed position.

A stopper, such as a gravity stopper 20, can be disposed in a stopper slot 30 so that the gravity stopper 20 can slide to block a dispenser exit opening 18, preventing inadvertent release of BBs from the dispenser groove 16. The user can align the dispenser exit opening 18 with the fill port of the BB gun (not shown) and, with BBs 28 in the dispenser groove 16, the user can tilt the dispenser 10, causing the gravity stopper 20 to move out of the closed position (FIG. 9) into an open position (FIG. 8) to allow the BBs in the dispenser groove 16 to be released, one-by-one, out of the dispenser exit opening 18.

Of course, the stopper can take other forms, such as a manual slide stopper, a twist stopper, a rotating closing member, or the like. In some embodiments, the stopper may not be present, where the user can simply fill the dispenser groove 16 with the dispenser 10 sloped away from the dispenser exit opening 18, tipping the dispenser 10 to release the BBs at the desired time. The stopper may be formed integrally with the dispenser exit opening 18 or may be a separate piece that attaches at the end of the dispenser groove 16, for example.

The dispenser 10 can be made from various materials. In some embodiments, the dispenser 10 can be made from a single piece of plastic. In other embodiments, the dispenser groove 16 may be removable or hingedly connected to the reservoir 24, providing a lid to the reservoir 24 and another method (or alternate method) to fill the reservoir 24 with BBs.

In some embodiments, the refill port 12 may be removed, where BBs are provided to the user already inside the dispenser, where the dispenser is designed to be a disposable unit or where the dispenser groove 16 is removable to provide a refill port as described above.

As discussed briefly above, to use the dispenser, the user can rotate the entire unit at least 90 degrees towards the dispenser groove 16 so that BBs cover the entire groove. When the unit is rotated, the gravity stopper 20 blocks the dispenser exit opening 18 so BBs 28 do not inadvertently pass through the dispenser exit opening 18 while being loaded into the dispenser groove 16. The unit is then rotated back to its original upright position, allowing all remaining BBs that did not fit into the dispenser groove 16 to fall back into the BB reservoir 24.

The user then lines up the dispenser exit opening 18 with whatever they are filling with BBs (e.g., a BB gun's refill opening), and tilts the unit so BBs pour out of the dispenser groove 16 through the dispenser exit opening 18.

The user can repeat these steps to pour another set of BBs from the dispenser 10. Each time these steps are repeated, BBs equal to the number that will fit in the dispenser groove 16 are poured out of the dispenser 10. The number of BBs depend on the length of the dispenser groove 16, which is dependent on the size of the overall unit.

While the above description focuses on the dispensing of BBs, aspects of the present invention could be used to distribute other spherical objects similar to BBs, such as pellets or ball bearings. The radius of the dispenser groove 16 and dispenser exit opening 18 may vary depending on the size of the spherical objects, but the functionality would remain the same.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The definitions of the words or elements of the following claims are defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A dispenser for spherical objects, comprising:

a reservoir for holding a plurality of the spherical objects;

a dispenser groove disposed along one side of the reservoir, the dispenser groove in fluid communication with the reservoir to permit at least a portion of the plurality of spherical objects to move from the reservoir to the dispenser groove, the dispenser groove formed with a partially curved inside shape to retain the portion of the plurality of spherical objects therein;

a dispenser exit opening at one end of the dispenser groove, the dispenser exit opening allowing the portion of the plurality of spherical objects to be released from the dispenser, one-by-one in a single file; and a stopper at the dispenser exit opening, the stopper movable between an open position, where the spherical objects can move out of the dispenser groove to an exterior of the dispenser, and a closed position, where the spherical objects are prevented from being released out of the dispenser exit opening, wherein the stopper is a gravity stopper including a pin movable in or out of a stopper slot by gravity, between the open position and the closed position.

2. The dispenser of claim 1, wherein the spherical objects are BBs.

3. The dispenser of claim 1, further comprising a refill port formed in at least one surface of the dispenser.

4. The dispenser of claim 3, wherein the refill port is a concave, funnel-shaped structure on a top side of the dispenser, the refill port having a refill hole formed at a bottom apex of the concave, funnel-shaped structure that communicates with an interior of the reservoir.

5. The dispenser of claim 3, further comprising a BB retainer disposed inside the reservoir preventing or minimizing the spherical objects from exiting the reservoir via the refill port.

6. The dispenser of claim 5, wherein the BB retainer is a dome shaped structure with its apex adjacent the refill hole.

7. The dispenser of claim 1, further comprising an internal wall extending alongside the dispenser groove, the internal wall providing an object groove fill path for the spherical objects to move into the dispenser groove.

8. The dispenser of claim 1, further comprising a slot cut along an exterior surface of the dispenser slot, the slot having a width smaller than a diameter of the spherical objects, the slot permitting a user to view the spherical objects disposed in the dispenser groove.

9. A dispenser for BBs, comprising:

a reservoir for holding a plurality of BBs;

a dispenser groove disposed along one side of the reservoir, the dispenser groove in fluid communication with the reservoir to permit at least a portion of the plurality of BBs to move from the reservoir to the dispenser groove, the dispenser groove formed with a partially curved inside shape to retain the portion of the plurality of BBs therein;

a dispenser exit opening at one end of the dispenser groove, the dispenser exit opening allowing the portion of the plurality of BBs to be released from the dispenser, one-by-one in a single file;

a refill port formed in at least one surface of the dispenser; and a stopper at the dispenser exit opening, the stopper movable between an open position, where the spherical objects can move out of the dispenser groove to an exterior of the dispenser, and a closed position, where the BBs are prevented from being released out of the dispenser exit opening, wherein the stopper is a gravity stopper including a pin movable in or out of a stopper slot by gravity, between the open position and the closed position.

10. The dispenser of claim 9, wherein the refill port is a concave, funnel-shaped structure on a top side of the dispenser, the refill port having a refill hole formed at a bottom apex of the concave, funnel-shaped structure that communicates with an interior of the reservoir.

11. The dispenser of claim 10, further comprising a BB retainer disposed inside the reservoir preventing or minimizing the BBs from exiting the reservoir via the refill port.

12. The dispenser of claim 9, further comprising an internal wall extending alongside the dispenser groove, the internal wall providing an object groove fill path for the spherical objects to move into the dispenser groove.

* * * * *